United States Patent [19]

Weis et al.

[11] 4,121,387

[45] * Oct. 24, 1978

[54] BLASTING MACHINE

[75] Inventors: Martin Weis, Ettlingen; Adolf Scholz, Karlsruhe, both of Germany

[73] Assignee: Badische Maschinenfabrik G.m.b.H., Germany

[ * ] Notice: The portion of the term of this patent subsequent to Sep. 20, 1994, has been disclaimed.

[21] Appl. No.: 666,417

[22] Filed: Mar. 12, 1976

[30] Foreign Application Priority Data

Mar. 12, 1975 [DE] Fed. Rep. of Germany ..... 2510827

[51] Int. Cl.[2] ..... B24C 3/14

[52] U.S. Cl. ..... 51/418; 51/419

[58] Field of Search ..... 51/14, 15, 215 R, 215 AR, 51/215 E, 419, 418; 134/140, 165

[56] References Cited

U.S. PATENT DOCUMENTS

| | | | |
|---|---|---|---|
| 3,292,310 | 12/1966 | Lefevre | 51/215 R X |
| 3,626,614 | 12/1971 | Powell | 51/9 X |
| 3,769,754 | 11/1973 | Ixer | 51/14 |
| 3,813,817 | 6/1974 | Häberlin | 51/15 |
| 3,852,919 | 12/1974 | Baughman | 51/15 |

FOREIGN PATENT DOCUMENTS

| | | | |
|---|---|---|---|
| 2,251,570 | 6/1973 | Fed. Rep. of Germany | 51/419 |

*Primary Examiner*—Gary L. Smith
*Attorney, Agent, or Firm*—Craig & Antonelli

[57] ABSTRACT

Workpiece carriers in the form of self-locking tongs are provided in a blasting machine having a blasting chamber, a charging station and a discharging station. The carriers are mounted overhung on individual support structures which are movable laterally outside the blasting chamber to transport workpieces within the chamber. Tongs comprising a support rod on the axis of rotation of the carrier, and a transverse gripper rod which is movable for clamping the workpiece, are particularly suitable for carrying cylinder block workpieces and for the charging and discharging operations. The machine may have several treatment stations which may be arranged in line or on a circle. Various drive means are described, as are means for recirculating the said support structures and means for blasting workpieces from below and from above.

28 Claims, 11 Drawing Figures

BLASTING MACHINE

The invention relates to a blasting machine having a blasting or treatment chamber which encloses at least one treatment station having means for blasting workpieces which are transported through the blasting chamber, from a charging or loading station to a discharging station, by workpiece carriers which are mounted laterally at their one end in cantilever or overhung relation outside the blasting chamber.

A multi-station blasting machine is known from German Offenlegungsschrift No. 1,752,601, which comprises a charging station, a blasting chamber and a discharging station, and has workpiece carriers in the form of cages which are mounted laterally at their one end in overhung relation outside the blasting chamber and are open at their other end for loading purposes. This known machine has two traction chains which lie adjacent to one another and in an approximately vertical plane, which chains transport the cages through the treatment chamber and through a second chamber with stations for the charging and discharging operations and also for clearing the blasting agent from the workpieces. In this arrangement, the blasting is effected only from above, since the forward travel of the workpieces is provided beneath them in the treatment zone. Separate, driven lock chambers are necessary in this case for sealing off the blasting chamber from the chamber for the remaining operations. Since centrifugal blast-producing wheels are only provided on the upper side of the blasting chamber, the operational efficiency is restricted, or the machine becomes very long when a large number of such wheels are necessary for a relatively high output.

A serious disadvantage is encountered when the dimensions of the workpieces vary, since then the workpiece carriers have to be replaced. This requires high investment costs, and extensive storage of different cages and change-over time periods, so that the efficiency is jeopardised.

Another known blasting machine, having an overhead conveyor arrangement, as disclosed in German Offenlegungsschrift No. 2,212,487, is concerned with the problem of treating workpieces of similar external form but different dimensions in a blasting chamber. In this machine the workpieces are rotated about a horizontal axis, while being gripped by two opposed, rotatable gripper devices, one of which is driven, the gripping being effected by axial displacement. It is also a disadvantage in this connection that the gripper devices have to be readjusted when the parts to be treated are changed. In addition, this method of support produces problems when the workpieces are heavy.

It is the object of the invention to avoid the disadvantages of the known arrangements and to propose an economical blasting machine, more especially for cylinder blocks of internal combustion engines, with which both large and small workpieces, also single-row or multiple-row workpieces and unsymmetrical workpieces, can be treated, even in a mixed sequence and without special preparation of the workpiece supports. Moreover, the blasting agent is to be able to be effective, unhindered, on as large as possible surface of the workpiece.

This object is achieved according to the invention by the workpiece carrier being constructed as a pair of tongs and mounted overhung on supporting structures or frames movable laterally of the blasting chamber. For the treatment of cylinder blocks, it is proposed in this connection that one part of the tongs is immovable and in the form of a supporting rod for engagement in a recess for a crankshaft bearing in the cylinder block. It is of advantage here if the supporting rod is fixed on the axis of rotation of the tongs. The possibility of holding wide, multi-row cylinder blocks in the same manner as narrow and small or unsymmetrical blocks is provided by the additional proposal that the movable part of the tongs comprises at least one transverse rod extending transversely of the supporting rod. In this way, there is obtained a coordinate support with a substantially linear or punctiform bearing of the workpiece.

The new machine with a tongs-like support for the workpieces provides for the treatment jet or blast the best possible access to all available surfaces. More especially with cylinder blocks, the burr-formation produced in manufacture in the recess for the crank-shaft bearing only allows the supporting rod of the tongs to bear in punctiform manner against the workpiece, so that in this case the surface of the workpiece does not show any areas which are not treated. Furthermore, there is the possibility of carrying out the automatic charging and discharging operations in a simple manner.

The novel workpiece carrier in the form of tongs also provides the possibility of itself acting as a charging and discharging appliance, by taking the workpieces from a supplying conveyor and transferring them to another conveyor after they have travelled through the blasting chamber. Constructional forms of the workpiece carrier in the form of tongs and of its driving means which make this possible are characterised in the subsidiary claims.

This blasting machine is in addition capable of being adapted to given local conditions, in that it is, for example, possible for the treatment stations of the blasting chamber to be arranged in a circle, the tongs and their holding means being arranged on a turntable and the stationary rotational and clamping drive means for the tongs at each treatment station being arranged on a platform at the centre so that they can be moved radially.

The invention is hereinafter described by a reference to a number of constructional forms which are shown, by way of example, in the accompanying drawings, wherein.

Figure 1:
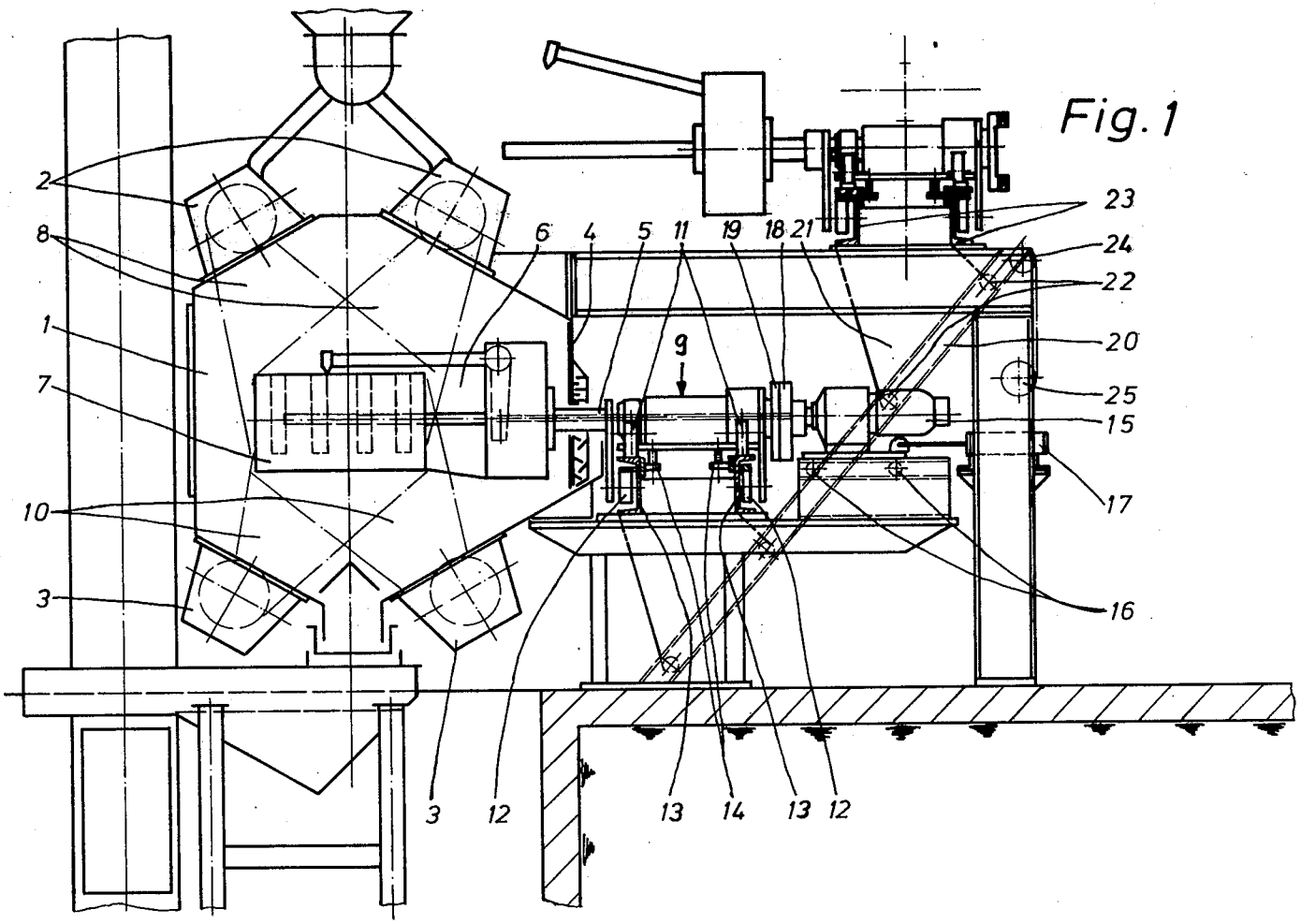
FIG. 1 is a cross-section through a blasting chamber, with the workpiece holding arrangement and the transport means at one treatment station.

Shown in FIG. 1 is the cross-section through an elongated blasting chamber 1 having turbines 2 producing a blast from above and turbines 3 producing a blast from below. Extending through one side wall 4 of the said chamber 2 is a hollow shaft 5, which comprises, at its end disposed in the blasting chamber, a workpiece carrier in the form of a pair of tongs 6, which holds a workpiece 7, for example, a cylinder block. In this position, the workpiece can be reached on all sides by the centrifugal blasting streams 8 and 10 from the turbines 2, 3. The blast not only has unimpeded access to the "open" surfaces, but is also able to penetrate into the coolant water ducts with their often small cross-sections.

The hollow shaft 5 is mounted in a supporting frame or structure 9, which is guided in the vertical direction on horizontal tracks 13 by means of four rollers 11 from above and four rollers 12 from below. For horizontal guidance, four lateral rollers 14 are provided. At each treatment station, of which one is shown in FIG. 1, a stationary turning motor 15 for the tongs 6 is displaceable axially by means of rollers 16 and by a driving arrangement 17. A clutch 18 is arranged between the turning motor 15 and the shaft 5.

Situated at both ends of the tracks 13 (in front of and behind the plane of the drawing) is an inclined elevator with guide rails 20, in which is guided an elevating bracketlike support 21 with rollers 22. The elevating support 21 carries rail sections 23 similar to the tracks 13 and of the length of the supporting structure 9. The elevating support 21 is moved by means of a cable system having a reversing roller 24 and a winch 25. This method of returning the empty supporting structures in a higher plane on the return path 75 (see FIG. 2) saves space. However, the empty supporting structures can also be returned behind or in front of the machine, in the same plane as for the forward travel, in which case the two inclined elevators are not required.

Figure 2:
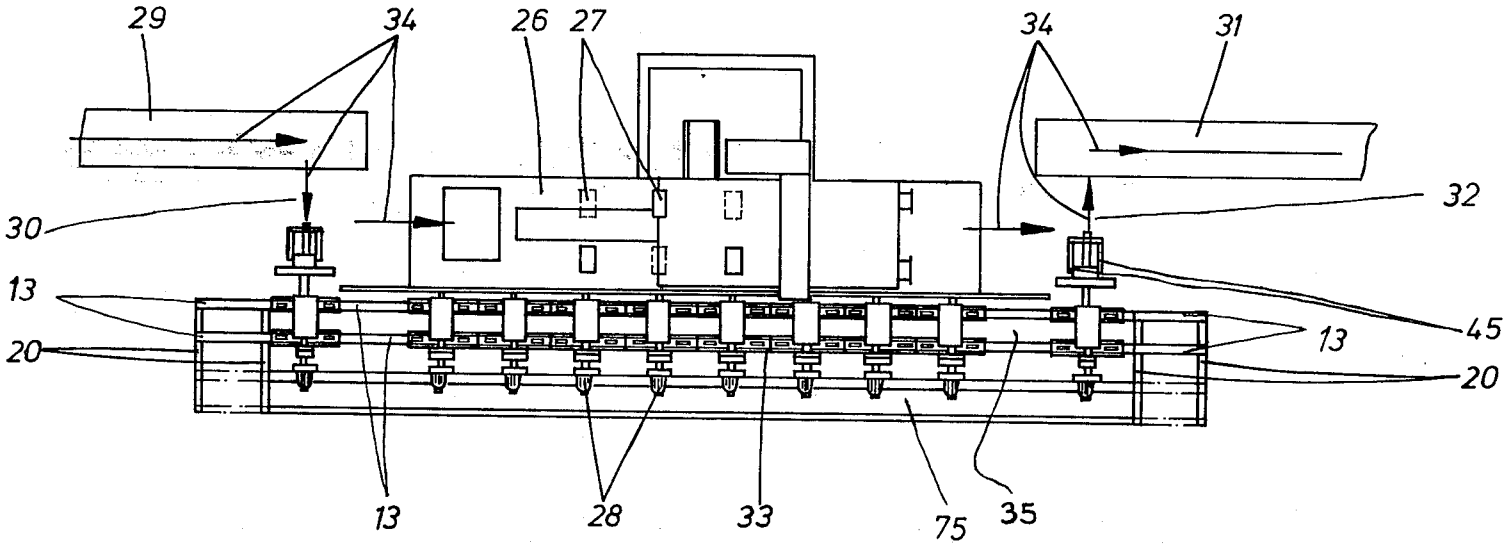
FIG. 2 is a top view of a blasting machine having a straight path of travel.

FIG. 2 shows a blasting chamber 26 with turbines 27 for a rectilinear path of travel of the workpieces, which chamber comprises the treatment stations and also pretreatment and post-treatment stations. The stationary rotational drive means for the tongs are indicated at 28. The supplying of workpieces takes place on a conveyor 29, which ends at the charging station 30. The discharge of treated workpieces is effected on a conveyor 31, on which the workpieces are deposited at the discharge station 32. The frames of the supporting structures 33 contact one another within the path of advancement 35, so that a closed sequence is formed, which is pushed through the treatment section by means, for example, of a cylinder and piston unit or a cyclic (or timed) feeding drive arrangement of generally known type. The arrows 34 indicate the path of the workpieces through the machine.

Figure 3:
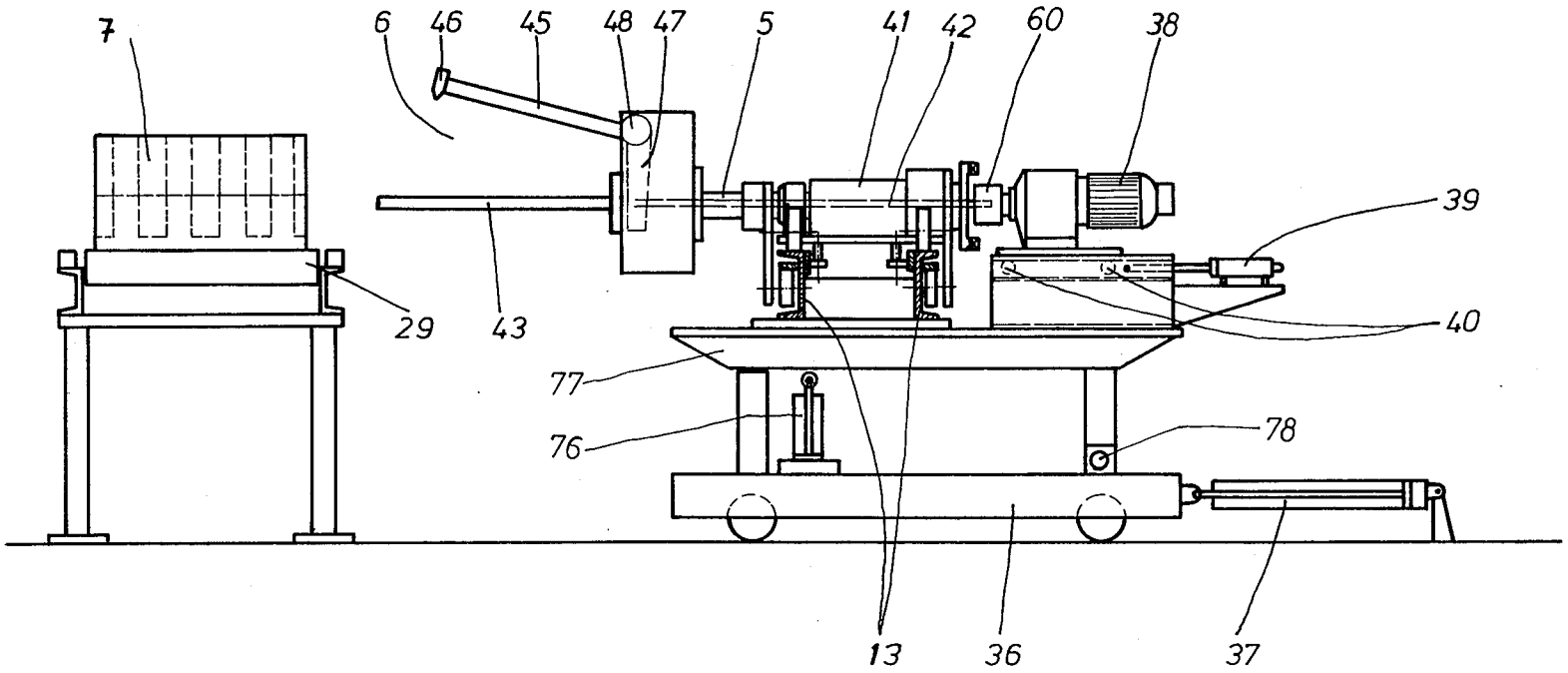
FIG. 3 is a side view of a charging or discharging station.

The conveyor 29 for the delivery of the workpieces 7 can once again be seen in FIG. 3. A section of the tracks 13 with the supporting frame or structure 41 is displaceable, on a carriage 36 having driving means 37, transversely of the direction of movement of the workpieces 7. Furthermore, the carriage 36 carries a drive means 38 for the tongs 6, the said drive means being movable relatively to the structure 41 by a driving arrangement 39 and by means of the rollers 40 in order to bring a clutch 60 into or out of engagement with a spindle 42, which is shown in broken lines and which is guided in the hollow shaft. The hollow shaft 5 carries an immovable part 43 which belongs to the tongs 6 and is in the form of a supporting rod which is arranged in the axis of rotation of the tongs. The movable part of the tongs consists of two parallel rods 45 (see also FIG. 2), which are connected by a transverse rod 46. The parallel rods 45 and the actuating lever 47 thereof, which is shown in broken lines, are interconnected by a common shaft 48. Using the driving arrangement 76, the pair of tongs 6 with a workpiece 7 can be raised by a swivelling movement of the superstructure 77 about the pivot 78, in order to lift the said workpiece from the conveyor 29. After the carriage 36 had been moved back into its initial position as illustrated, the automatic loading operation is terminated. The supporting structure or frame 41 with the workpiece 7, after release of the clutch 60, can be introduced into the blasting chamber 26 (FIG. 2) by the pusher or thrust driving arrangement. Because of the self-locking mechanism in the form of the spindle 42, the tongs remain in the clamped position.

Figure 4:
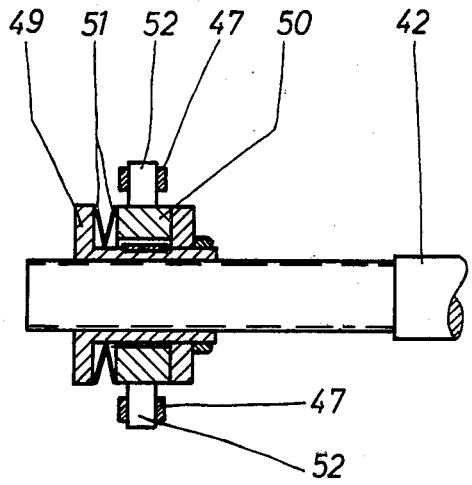
FIG. 4 is a detail, in section, of tongs actuating means.

FIG. 4 illustrates one embodiment of the self-locking mechanism. The spindle 42 is constructed to be self-locking with a nut 49. Provided on the nut for sliding movement, but non-rotatable, is a sleeve 50, which is supported by means of plate springs 51 against the nut with the transmission of the closing force of the tongs. The actuating lever 47 (see FIG. 3) engages in the manner of a fork on a projecting stud 52 of the sleeve 50.

Figure 5:
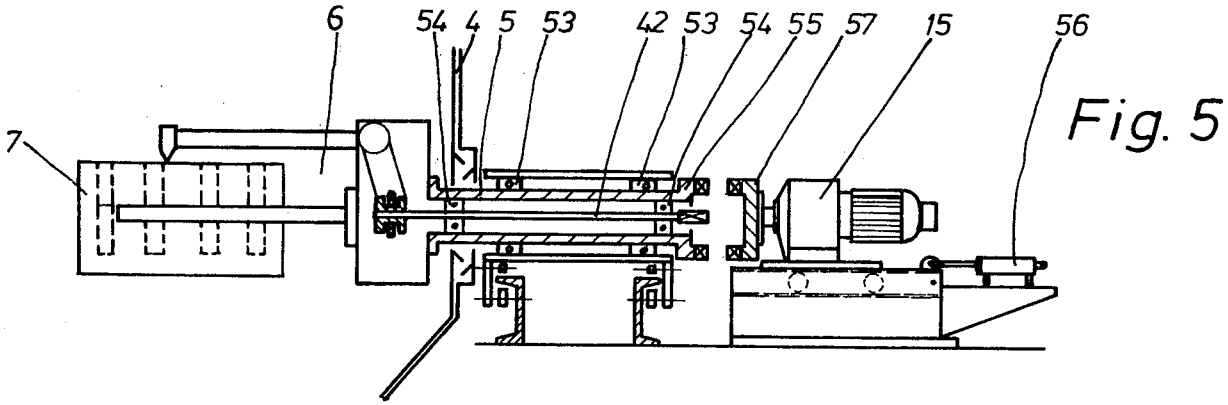
FIG. 5 is a longitudinal section through the workpiece holding arrangement with rotating and clamping means, to a larger scale.

The side wall 4 of the blasting chamber can once again be seen in FIG. 5. The hollow shaft 5 which is carrying the tongs 6 and the workpiece 7 is mounted in bearings 53, which are supported in a bearing box or housing enclosing the hollow shaft. The spindle 42 is held in the bearings 54 so that it is rotatable but not displaceable in the hollow shaft 5. The hollow shaft carries a dog clutch 55 at one end. By axial displacement of the rotatable driving means 15 by means of the drive arrangement 56, there is produced the connection between the rotatable driving means and the tongs. No action is exerted on the spindle 42 at this time, so that the tongs remain in the closed state which is established by the self-locking arrangement. The stationary rotational driving means 15 at the separate treatment stations can either rotate continuously or can be controlled in an oscillating rotary movement, so that the workpiece executes an oscillating or rocking movement in the blasting chamber.

Figure 6:
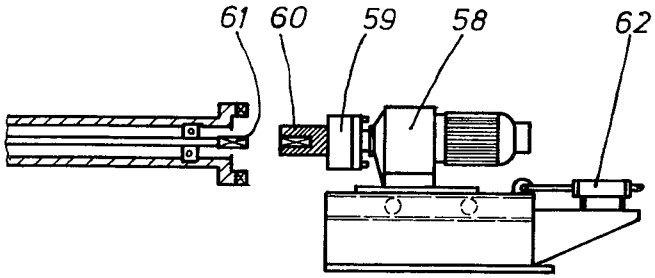
FIG. 6 is a view of driving means for the tongs, partly in section.

Represented in FIG. 6 at 58 is a driving means for the spindle 42, as used at the charging and discharging stations (FIG. 2). Fixed on the free end of the shaft of the driving means 58 is the primary part of a slipping clutch 59 constituting a torque-limiting means. The secondary part of the slipping clutch 59 terminates in a sleeve 60 having an internal square recess. The spindle 42 is provided at the end with an external square portion 61 which fits into the sleeve 60. The coupling effect is obtained by displacement of the drive means 58 by means of a sliding drive arrangement 62. With the clamping of a workpiece 7 by actuating the driving means 62 and 58, the spring 51 (see FIG. 4) is tensioned after closure of the tongs 6 by the continued travel of the spindle. After the drive means 58 have been uncoupled, the spring tension is maintained because of the self-locking of the thread of the nut until reverse rotation of the spindle occurs at the discharging station 32 (see FIG. 2).

Figure 9:
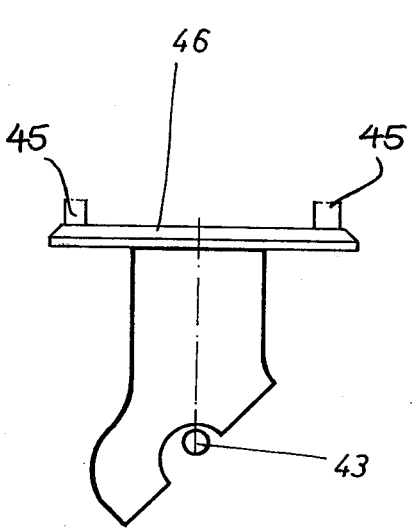
FIG. 9 is a view of an unsymmetrical, single-row cylinder block in the clamping tongs.
Figure 7:
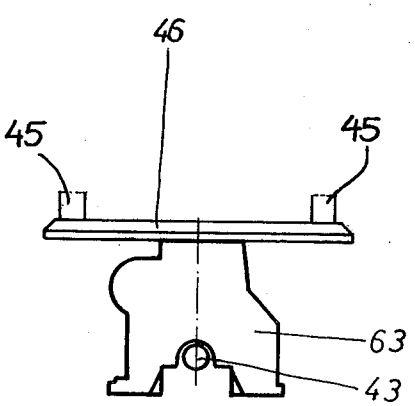
FIG. 7 is a view of a single-row cylinder block in the clamping tongs.
Figure 8:
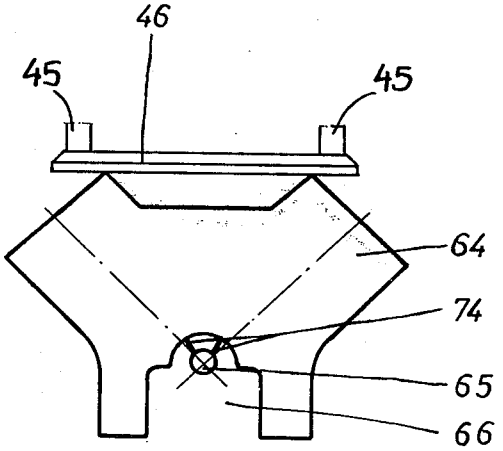
FIG. 8 is a view of a two-row cylinder block in the clamping tongs with a two-edged transverse rod.

FIGS. 7, 8 and 9 show how it is possible, by means of a workpiece carrier of identical design, namely, a pair of tongs with the supporting rod 43 and a transverse rod 46 connecting two parallel rods 45, for different cylinder blocks to be held without making any modifications. FIG. 7 shows a small, single-row cylinder block 63, while FIG. 8 shows a large, V-type cylinder block 64; in the last-mentioned case, a supporting rod 65 bears with two edges 74 against the recess 66 for the crankshaft. FIG. 9 illustrates how a single-row, unsymmetrical cylinder block is accommodated in the tongs. The entire surface of contact of the workpiece carrier and workpiece is restricted to a few lines or points.

Figure 11:
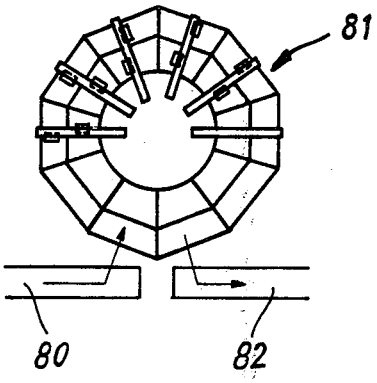
FIG. 11 is a diagrammatic plan view of a blasting machine according to FIG. 10, to a smaller scale.
Figure 10:
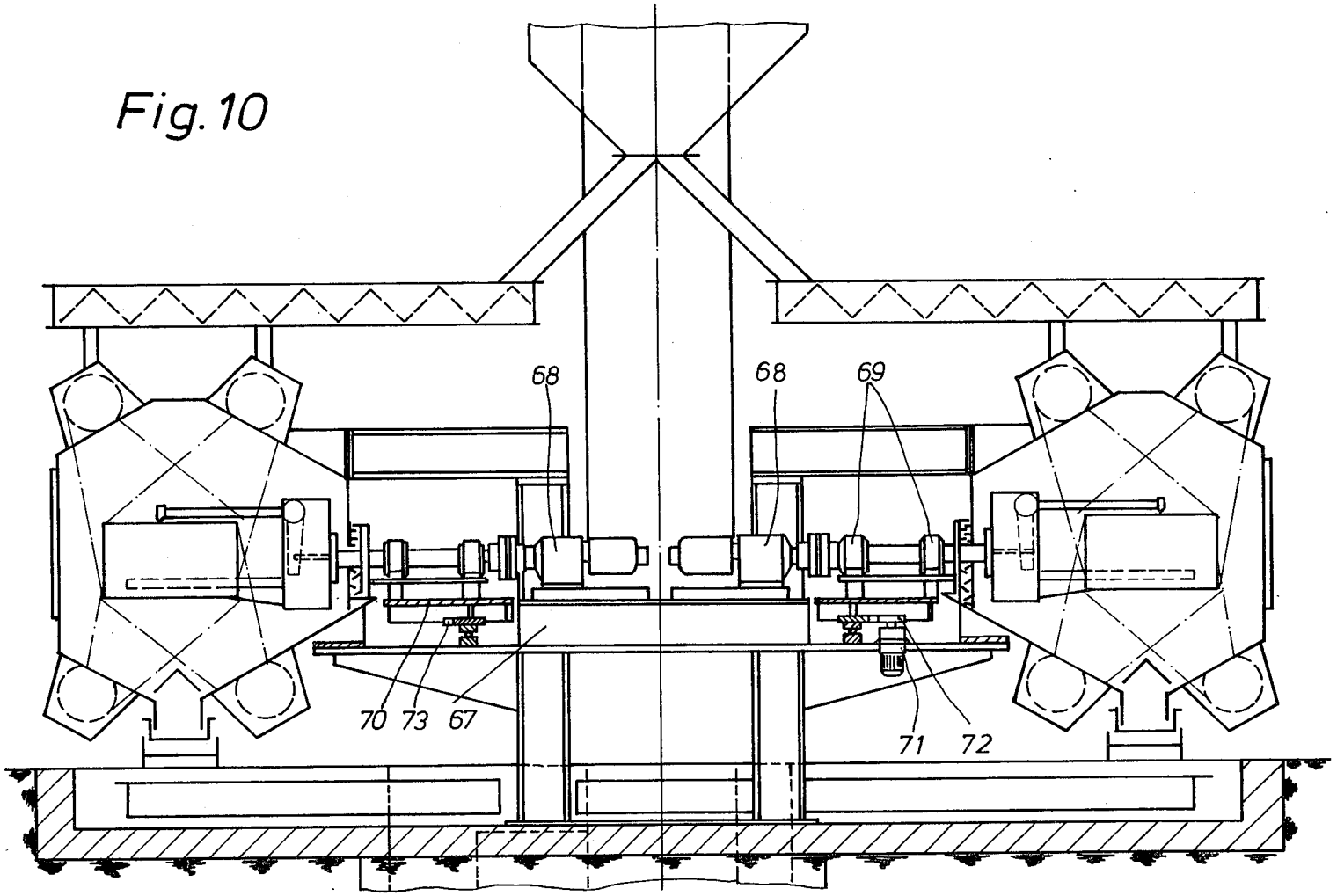
FIG. 10 is a cross-section through a blasting machine in which the path of travel is circular.

FIGS. 10 and 11 illustrate the construction of a blasting machine in which the workpiece carriers and workpieces follow a circular path. In this arrangement, a fixed platform 67 in the centre of the machine carries the rotational drive means 68 or the clamping means for the tongs, which means are stationary, but can be displaced longitudinally. The support bearings 69 for the tongs are arranged in a fixed position on a turntable 70, which is set intermittently in rotation by means of the drive means 71 by way of a pinion 72 and a ring gear 73. FIG. 11 shows the supply of the workpieces from a conveyor 80 into the circular blasting chamber 81 and the discharge from said chamber on to a conveyor 82 which picks up the workpieces.

We claim:

1. A blasting machine having a blasting chamber which encloses at least one treatment station, a charging station before and a discharging station after the blasting chamber, and workpiece carriers which are mounted laterally at their one end in overhung relation outside the blasting chamber, the workpiece carriers being constructed as pairs of tongs and mounted overhung on supporting structures movable laterally of the blasting chamber, and wherein the tongs are held by a self-locking mechanism comprising a threaded spindle in the closed position.

2. A blasting machine according to claim 1, wherein the tongs arrangement has at least two workpiece engaging parts, one part of the tongs arrangement being moveable, and another part being immovable and in the form of a supporting rod for engagement in a recess for a crankshaft bearing in a cylinder block to be blasted.

3. A blasting machine according to claim 2, wherein the supporting rod has a longitudinal profile which bears with at least two lines of contact in the recess for the crankshaft bearing.

4. A blasting machine according to claim 2, wherein the tongs rotate about an axis and the supporting rod is arranged on the axis of rotation of the tongs.

5. A blasting machine according to claim 2, wherein the movable part of the tongs comprises at least one transverse rod extending transversely of the supporting rod.

6. A blasting machine according to claim 5, wherein the movable part of the tongs comprises two parallel rods which are connected by the transverse rod.

7. A blasting machine having a blasting chamber which encloses at least one treatment station, a charging station before and a discharging station after the blasting chamber, and workpiece carriers which are mounted laterally at their one end in overhung relation outside the blasting chamber, the workpiece carriers being constructed as pairs of tongs and mounted overhung on supporting structures movable laterally of the blasting chamber, and wherein the tongs are supported by a hollow shaft which can be driven and which is guided with a sealing effect through a slot in the side wall of the chamber and which is arranged to be coupled at each treatment station with a stationary rotational drive means.

8. A blasting machine according to claim 7, wherein the drive means for closing and opening the tongs is guided through the hollow shaft.

9. A blasting machine according to claim 7, wherein a shaft rotatable in the hollow shaft is provided as drive means for the tongs, which shaft can be coupled at the loading and discharging stations with a stationary drive means.

10. A blasting machine according to claim 1, wherein the stationary drive means for the threaded spindle is provided at the charging station with a torque-limiting means.

11. A blasting machine according to claim 10, wherein a spring element is arranged between the parts transmitting the clamping forces of the tongs.

12. A blasting machine according to claim 7, wherein the stationary rotational drive means of the tongs are reversible and controllable to provide an oscillatory rotational movement in any desired adjustable positions of the tongs.

13. A blasting machine according to claim 7, wherein the tongs are rotatable about an axis and the supporting structure, including drive means for the tongs, is movable horizontally in the direction of the axis of rotation of the tongs and is arranged to be raised at the loading and discharging station.

14. In a blasting machine of the type having a blasting chamber, at least one treatment station having one or more blasting turbines, a loading station preceding the blasting chamber, an unloading station following the blasting chamber, and workpiece carrying means, the improvement comprising:

carriage means mounted laterally outside of said blasting chamber for moving said workpiece carrying means laterally with respect to said chamber;

workpiece gripping means constructed of rod-shaped elements arranged to form rotatable workpiece gripping jaws;

said workpiece gripping means being connected to said carrying means so as to be moveable laterally within the blasting chamber by said carriage means, the further improvement comprising: several treatment stations being arranged in the blasting chamber in a circle, said workpiece carrying means being secured to a turntable, and stationary rotational and clamping drive means for the jaws being disposed on a platform at the centre of the turntable and arranged to be displaceable radially thereof.

15. In a blasting machine of the type having a blasting chamber, at least one treatment station having one or more blasting turbines, a loading station preceding the blasting chamber, an unloading station following the blasting chamber, and workpiece carrying means, the improvement comprising:

carriage means mounted laterally outside of said blasting chamber for moving said workpiece carrying means laterally with respect to said chamber;

workpiece gripping means constructed of rod-shaped elements arranged to form rotatable workpiece gripping jaws;

said workpiece gripping means being connected to said carrying means so as to be moveable laterally within the blasting chamber by said carriage means;

said jaws being formed of a first immoveable part a second part angularly displaceable relative to said first part so as to enable said workpiece to be gripped therebetween.

16. In a blasting machine according to claim 15, the further improvement comprising: said blasting turbines being arranged in the blasting chamber so as to blast the workpiece from below and from above.

17. In a blasting machine according to claim 15, the further improvement comprising said gripping jaws being detachably connected to said carrying means for easy replacement.

18. The blasting machine according to claim 15, the further improvement comprising: the carrying means including a drive means for the jaws being moveable horizontally in the direction of an axis of rotation of the jaws and being arranged to be raised at the loading and discharging stations.

19. In a blasting machine according to claim 15, the further improvement comprising: said blasting machine having several treatment stations, and wherein the dimension of the carrying means in the direction of travel of the workpieces corresponds to the spacing of the treatment stations from one another.

20. A blasting machine according to claim 19, wherein the carrying means form a closed series in the path of advance and are moved by a cyclic feeding drive arrangement.

21. A blasting machine according to claim 20, having a return path for the supporting structures, which is arranged obliquely above the feeding path.

22. A blasting machine according to claim 21, wherein the transport on the return path is effected with a traction chain.

23. A blasting machine according to claim 22, wherein an inclined elevator is arranged at each of the two ends of the feeding path.

24. In a blasting machine of the type having a blasting chamber enclosing at least one treatment station having one or more blasting turbines, a loading station preceding the blasting chamber, an unloading station following the blasting chamber, and workpiece carrying means, the improvement comprising:

carriage means mounted laterally outside of said blasting chamber for moving said workpiece carrying means laterally with respect to said chamber;

workpiece gripping means constructed of elements arranged to form rotatable workpiece gripping jaws; and said workpiece gripping means being connected to said carrying means so as to be moveable laterally within the blasting chamber by said carriage means; and the connection between said workpiece gripping means and said workpiece carrying means being constructed such that only said gripping means is extendable within the treatment station of said blasting chamber so as to be exposed to said one or more blasting turbines, and further comprising:

said jaws being formed of a first immoveable part and a second part angularly displaceable relative to said first part so as to enable said workpiece to be gripped therebetween.

25. In a blasting machine according to claim 24, the further improvement comprising said gripping jaws being detachably connected to said carrying means for easy replacement.

26. In a blasting machine of the type having a blasting chamber enclosing at least one treatment station having one or more blasting turbines, a loading station preceding the blasting chamber, an unloading station following the blasting chamber, and workpiece carrying means, the improvement comprising:

carriage means mounted laterally outside of said blasting chamber for moving said workpiece carrying means laterally with respect to said chamber;

workpiece gripping means constructed of elements arranged to form rotatable workpiece gripping jaws; and said workpiece gripping means being connected to said carrying means so as to be moveable laterally within the blasting chamber by said carriage means; and the connection between said workpiece gripping means and said workpiece carrying means being constructed such that only said gripping means is extendable within the treatment station of said blasting chamber so as to be exposed to said one or more blasting turbines, and further comprising:

a first immoveable part of said jaws being constructed as a supporting rod engageable in a recess in the workpiece, and a second moveable part of said jaws being constructed of at least one rod extending transversely of said supporting rod.

27. In a blasting machine according to claim 26, the further improvement comprising said moveable part being further constructed of two parallel rods connected by said transverse rod.

28. A blasting machine having a blasting chamber which encloses at least one treatment station, a charging station before and a discharging station after the blasting chamber, and workpiece carriers which are mounted laterally at their one end in overhung relation outside the blasting chamber, the workpiece carriers being constructed as pairs of tongs and mounted overhung on supporting structures movable laterally of the blasting chamber, wherein the supporting structure, including drive means for the tongs, is movable horizontally in the direction of an axis of rotation of the tongs and is arranged to be raised at the loading and discharging station.

* * * * *